United States Patent [19]

Jones

[11] 3,991,978

[45] Nov. 16, 1976

[54] SUBMERSIBLE PUMP BOOM

[75] Inventor: William Jones, Mount Kisco, N.Y.

[73] Assignee: The Raymond Lee Organization, Inc., New York, N.Y. ; a part interest

[22] Filed: Mar. 17, 1975

[21] Appl. No.: 558,849

[52] U.S. Cl. ..... 254/139; 248/539; 248/221 D

[51] Int. Cl.[2] ..... B66C 23/60

[58] Field of Search ..... 254/134.3 R, 135 R, 254/139, 139.1, 145; 248/221, 43; 166/75, 85, 77, 92, 93, 98, 99; 52/731, 726, 300, 301; 403/300, 305; 212/1; 116/173; 182/128; 214/75 H

[56] References Cited

UNITED STATES PATENTS

| | | | |
|---|---|---|---|
| 660,272 | 10/1900 | Martin et al. | 212/64 |
| 998,306 | 7/1911 | Roman | 212/57 |
| 1,662,884 | 3/1928 | Cruickshanks | 403/305 |
| 2,252,514 | 8/1941 | Kuenzi | 254/139 |
| 3,128,081 | 4/1964 | Buschbom | 254/139 |
| 3,741,525 | 6/1973 | Smedley | 254/139 |

*Primary Examiner*—Robert J. Spar
*Assistant Examiner*—Lawrence J. Oresky
*Attorney, Agent, or Firm*—Howard I. Podell

[57] ABSTRACT

A boom for pulling or replacing a submersible pump from a subterranean well. The boom is constructed of a multi-sectional telescopic rod unit mounted vertically to a flanged sleeve base member which fits onto the well casing. A pulley is fixed to the top of the vertical rod, with a winch assembly affixed to the rod member above the base member.

3 Claims, 5 Drawing Figures

GROUND

SUBMERSIBLE PUMP BOOM

SUMMARY OF THE INVENTION:

My invention relates to a submersible pump boom that may be employed for the removal or replacement of a pump from a subterranean well. The apparatus is constructed of a multi-sectional telescopic rod member fitted to a flanged sleeve base member that may be mounted onto the well casing so as to support rod member in a vertical orientation. Detachable legs may be alternately attached to the base member for the erection of the derrick over a well hole.

A winch is mounted on the rod member with the winch hoisting rope passing over a pulley at the top of the erected rod member. The rod member extends preferably to a height greater than 21 feet so as to enable the raising or lowering of a submersible pump joined by standard 21 foot lengths of pipe to the surface of the well, in the installed condition.

BRIEF DESCRIPTION OF THE DRAWING:

The objects and features of the invention may be understood with reference to the following detailed description of an illustrative embodiment of the invention, taken together with the accompanying drawings in which.

Figures 1, 2, 3, 4, 5:
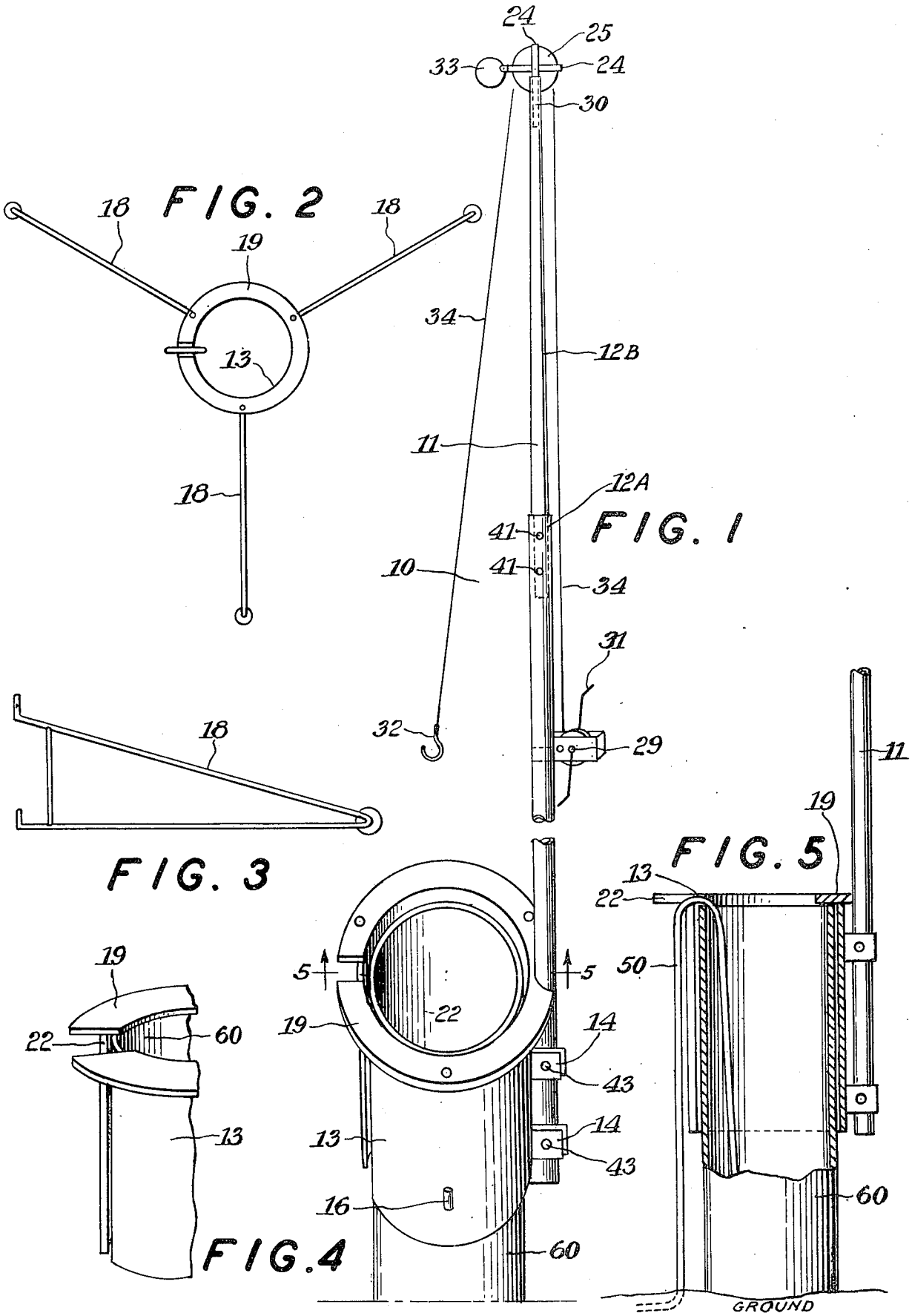
FIG. 1 illustrates a perspective view of the invention.
FIG. 2 illustrates a plan view of the optional attachable legs of the invention, attached to the base.
FIG. 3 illustrates a side view of an attachable leg.
FIG. 4 illustrates a fragmention perspective view of the sleeve base member; and, FIG. 5 illustrates a sectional view of the sleeve base member taken along line 5—5 of FIG. 1.

DESCRIPTION OF THE PREFERRED EMBODIMENT:

Turning now descriptively to the drawings, in which similar reference characters denote similar elements throughout the several views, FIGS. 1–5 shows a submersible pump boom apparatus 10 employed for the extraction or replacement of a submersible pump and piping from a well. The apparatus is constructed of a two sectional telescopic tubular rod assembly 11. The two rods 12A and 12B are joined together in the extended position through anchor bolts 41, and mounted in vertical orientation by bolts 43 to brackets 14 on the side of a flanged sleeve base member 13. Sleeve base member 13 is of an internal diameter to fit about the well casing, with the flange 19 of the sleeve resting on the top of the well casing. The flange 19 internal diameter is that of the internal diameter of the well casing bore.

A winch 29, manually operated by a handle 31, is mounted on the rod 11 with the winch rope 34 running from the winch 29 to a rotatable pulley 25 mounted to the top 30 of the rod 11 and secured by guide members 24, and the rope 34 ending in a hoisting hook 32. A circular sleeve 33 is mounted to a top pulley guide 24 to guide a plastic pipe during installation to prevent bending of the pipe.

Attachment members 16 are externally fitted to the base sleeve 13 for attachment of wire legs 18 to the side of base sleeve 13, when the device is erected above a well.

An open slot 22 is formed along the length of sleeve 13 to enable the sleeve to fit onto a well casing about a transverse pipe 50 leading into the well opening.

The apparatus 10 is portable and readily erected in place to lift or lower a pump joined by pipe lengths that are less than the extended height of erected rod 11. Attachable legs 18 are only added when it is desired to mount the base sleeve 13 above the well casing or where the well casing 60 is not in condition to be mounted to the base sleeve 13.

Since obvious changes may be made in the specific embodiment of the invention described herein, such modifications being within the spirit and scope of the invention claimed, it is indicated that all matter contained herein is intended as illustrative and not as limiting in scope.

Having thus described the invention, what I claim as new and desire to secure by Letters Patent of the United States is:

1. A boom unit for use in lifting or lowering a submersible pump and attached piping in a well through a well casing to which the boom unit is fastened, comprising an extendable multi-sectional telescopic rod member joined to the external side of a hollow base sleeve, said base sleeve being a cylindrical column which substantially surrounds said well casing and is fitted with means to detachably support said sleeve on said well casing whereby in the operative position the base sleeve is supported solely by said well casing, with a winch mounted on the rod member and a freely rotating pulley mounted on the free end of the rod member, said rod member being extendably parallel to the axis of the bore of the said sleeve.

2. A boom unit for use in lifting or lowering a submersible pump and attached piping in a well, comprising an extendably multi-sectional telescopic rod member joined to the side of a base sleeve, said base sleeve formed with a projecting flange, with a winch mounted on the rod member and a freely rotating pulley mounted on the free end of the rod member, in which the inner diameter of the said base sleeve is of a size to fit about the outer diameter of a well casing, and the flange of the sleeve is of a size to project about the top of the said well casing, with the internal diameter of said flange being less than the internal diameter of the said base sleeve and less than the external diameter of a well casing about which the sleeve may be mounted.

3. The combination as recited in claim 2 in which the internal diameter of the flange of the base sleeve is of the general dimension of the internal bore diameter of a well casing to which the said sleeve is fitted, so that the flange lies generally flush, in the installed position, with the bore diameter of a well casing to which it may be installed.

* * * * *